United States Patent [19]

Torres

[11] 3,946,453

[45] Mar. 30, 1976

[54] COMBINATION PLIER, WRENCH AND SCREWDRIVER TOOL

[76] Inventor: Ruben J. Torres, 1238 N. Greenview, Chicago, Ill. 60622

[22] Filed: Jan. 27, 1975

[21] Appl. No.: 544,184

[52] U.S. Cl. ..... 7/4; 81/418

[51] Int. Cl.[2] ..... B25B 7/22

[58] Field of Search ..... 7/3 R, 4, 3 A, 1 F, 5; 81/418, 121 R, 121 A, 121 B, 125.1

[56] References Cited

UNITED STATES PATENTS

| | | | |
|---|---|---|---|
| 389,553 | 9/1888 | Diefendorf | 7/3 A |
| 2,605,665 | 8/1952 | Grenat | 81/125.1 |
| 3,121,356 | 2/1964 | Davis | 81/125.1 |
| D119,441 | 3/1940 | Sandy | 7/4 |
| D136,188 | 8/1943 | Payne | 7/4 |

FOREIGN PATENTS OR APPLICATIONS

| | | | |
|---|---|---|---|
| 475,530 | 3/1915 | United Kingdom | 7/3 A |
| 444,355 | 3/1936 | United Kingdom | 7/121 R |

*Primary Examiner*—Al Lawrence Smith
*Assistant Examiner*—Roscoe V. Parker
*Attorney, Agent, or Firm*—Richard G. Kinney

[57] ABSTRACT

A combination tool of the plier type which includes a screwdriving blade at one plier jaw point and wrench means presenting a smooth pressing surface at the end of both of the arms connected to the screw-driving blade. The other arm of the plier may be held at a right angle and serves as a lever arm when the tool is used for driving or loosening screws. The wrench means may be a pair of coaxially aligned different sized box wrenches formed unitarily, or a unitarily formed pair of open wrenches opening to the side and may be formed at the ends of each plier arm to provide four different sized wrenches.

9 Claims, 7 Drawing Figures

3
26
26R
16H
3
16
14J
15
22
14H
18
10
14
12
16J 22
24
10
14
16
12
15
18
20

26W
26R

26

5
22'
26W'

5
10'
14H'

26'

16H'

24
16
10"

12
14J
16J
18

26R'
26W'
14H'

COMBINATION PLIER, WRENCH AND SCREWDRIVER TOOL

Field of the Invention

The present invention is an improvement in combination tools and is especially concerned with combination tools of the plier type.

BACKGROUND OF THE INVENTION

Combination tools have been known for some time. One plier type combination tool is described in U.S. Pat. No. 1,321,777 which issued in 1919. That tool combined a plier screwdriver and adjustable wrench. Other such tools are shown in U.S. Pat. Nos. 1,739,658, 1,802,666, 2,271,680 and the recently issued U.S. Pat. No. 3,760,473.

Although combination tools of the plier type have been known for many years and have the advantages of convenience and lighter weight over separate tools to do the same jobs, they have generally achieved these advantages at the cost of efficiency for one or more of the specific tasks for which they are adopted. That is, in attempting to be jacks of all trades, they are rarely able to master even one. For example, the tools shown in U.S. Pat. Nos. 1,321,777 and 1,739,658 feature a screwdriver blade at the end of one of the handles of a plier. Now, as anyone who has used such a tool as shown in U.S. Pat. No. 1,739,658 as a screwdriver will attest, this arrangement is far from satisfactory. The main drawback is the requirement that the user grip the sharp jaws of the plier when applying pressure down on the screw to be driven. The U.S. Pat. No. 1,321,777 tool overcomes this disadvantage to some extent but only at the cost of added provisions and inconvenient extra operations in setting up the tool for use.

Further, when trying to extract a stubborn screw with non-combination tools, it is often convenient to use pliers or a wrench to grip the screwdriver shaft to apply more torque to the screw than is easily done through the screwdriver handle alone. If one has only a combination plier tool, this dual use of plier and screwdriver can either not be done or not be done well.

SUMMARY OF THE INVENTION

In overcoming these disadvantages of the prior art and in achieving other advantages, a combination tool made in accordance with the present invention includes a first and second plier member, each having a jaw section and a handle section. The members are pivotally attached together to allow the jaws to move together in the conventional manner. However at least one of said jaw sections includes a screwdriver blade formed at its point end and its associated handle section has a wide smooth end portion to aid in gripping it when used as a screwdriver.

This novel arrangement has the advantage that the other plier member may be used as a lever arm which, as it is already affixed to the screwdriver blade bearing member near the blade, is ideally located for this application. Alternatively, in accordance with a second feature of the invention, the screwdriver blade point extends slightly more than the jaw of the other plier section so that both handle sections may be held together and the tool used in that configuration as a screwdriver.

Yet another feature of the invention involves the use of, as the smooth end portion, a piece of fixed opening wrenches (box or opening to the side) formed one above the other with their openings continuing into each other and both with approximately superimposed central axes. This arrangement provides for an increased lever arm or torque for at least some applications.

BRIEF DESCRIPTIONS OF THE DRAWINGS

The invention, together with further advantages thereof, may best be understood by reference to the following descriptions taken in connection with the accompanying drawings, in the separate figures of which like reference numerals identify like elements, therein which.

DETAILED DESCRIPTION

Figure 1:
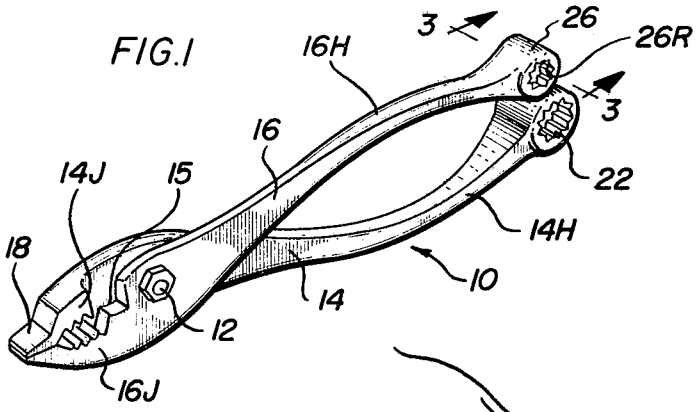
FIG. 1 is a perspective view of a combination tool constructed in accordance with the present invention.

Referring now to FIG. 1, there is depicted one embodiment of a combination tool, generally indicated by the numeral 10, and constructed in accordance with the present invention. The tool 10 includes a pair of pivoted, at 12, plier members 14 and 16 each of which includes in a conventional manner a jaw section 14J, 16J and handle section 19H, 16H formed together into a unitary structure.

Figure 2:
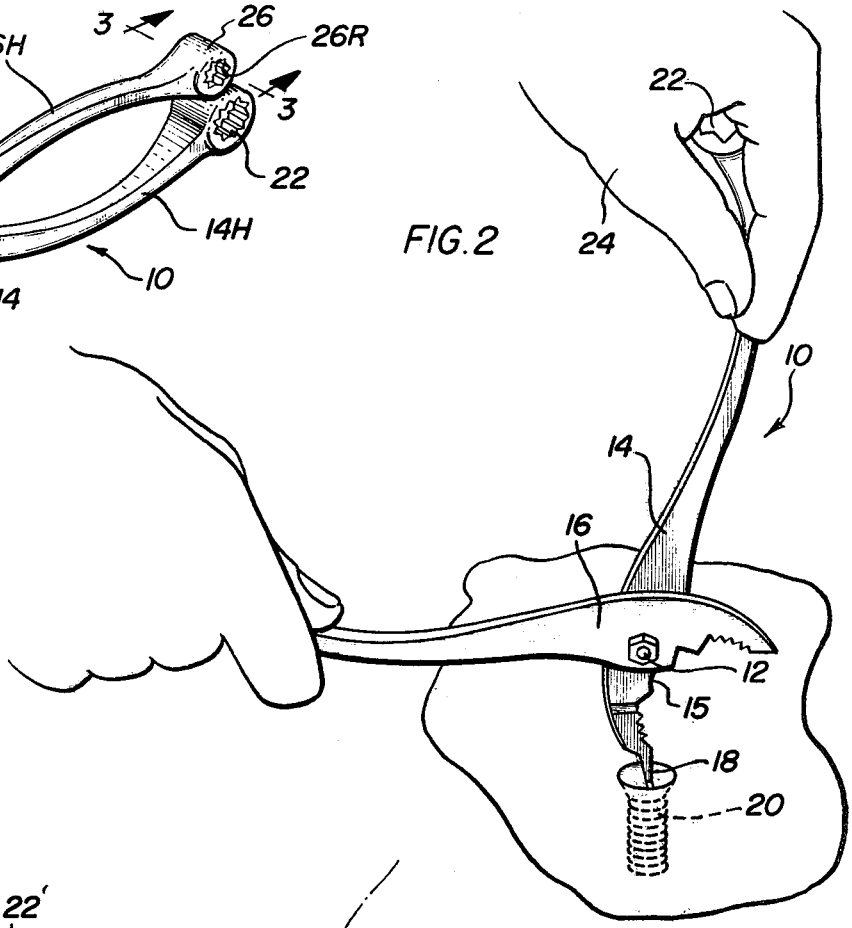
FIG. 2 is a perspective view of the combination tool of FIG. 1 shown in use as a screwdriver capable of exerting increased torque.

The tool 10 is preferably, but not necessarily, also provided with wire cutting jaws 15. In accordance with one feature of the present invention the jaw section 14J has a novel screwdriver point ending 18 which may serve, as shown in FIG. 2, as a screwdriver. FIG. 2 illustrates one advantage of this construction in that it permits the member 16 to be used as a lever arm greatly increasing the torque that may be applied in extracting or driving a machine screw 20.

In accordance with the present invention, the tool 10 includes a relatively large end 22 at the handle section 14H of the screwdriving member 14. This large end 22 presents a relatively smooth surface to the gripping hand 24 and thus overcomes one of the disadvantages of some prior plier combination tools which place their screwdriving point at the end of a handle and require the user to grip and apply pressure against the relatively sharp jaw section.

Note should also be made of the fact that the lower plier member 16 is connected (at 12) at a point relatively close to the screwdriving point 18. This results in the advantage, when applying torque as shown in FIG. 2, of applying it close to the point 18.

Figure 3:
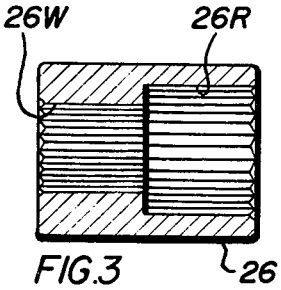
FIG. 3 is a sectional view of a portion of the tool of FIGS. 1 and 2 as seen from the plane indicated by 3—3 in FIG. 1 when looking in the direction there indicated.

In accordance with another feature of the present invention, the end portion 22, and the corresponding end 26 of the member, is formed, as best seen in FIGS. 1 and 3, of two differing sized box wrenches which in the case of end 26 are designated 26W and 26R. These are preferably formed together in a unitary manner for greater strength and the larger sized wrench 26R is preferably of a greater depth so as to allow it to fit over a nut more easily. Although, if made of a sufficient depth such a relationship need not be adopted. However, this preferred arrangement allows for both box wrenches to be effectively used and yet form a small unit with a savings of metal and weight. Note should be taken that the box wrenches have their openings aligned and opening into each other so as to allow a bolt protruding from a nut gripped by the larger wrench section, to extract through the opening of the smaller wrench section. Although the wrenches 26W and 26R are preferably aligned about a common central axis as shown, they may be slightly offset, for example, the smaller wrench having its axis more outward. This would allow some saving of metal and weight, and still present a relatively smooth outer end. However, they should not be so far offset that the protruding bolt portion from a nut may contact the smaller wrench's inside surface.

As a concrete example, a prototype of the invention employed box end wrenches 26W and 26R of 7/16 inch and ⅜ inch sizes and box wrenches 22W and 22R of 9/16 inch and ½ inch. Although the wrench segments of units 22 and 26 are preferably made unitarily, in at least its broader aspects, the present invention could also be practiced by forming them by two separated wrench segments secured to the handle so as to present the functional equivalent of the depicted unitary structure. The unitary construction however has the advantages of greater strength and of providing a smoother end surface for gripping the tool.

Also, although a slight offset of the wrenches may be employed, their axes should be arranged so as to provide clearance for a protruding bolt and thus avoid the disadvantages of such prior art combination wrenches such as those of U.S. Pat. Nos. 1,571,580 and 1,584,422.

Figure 4:
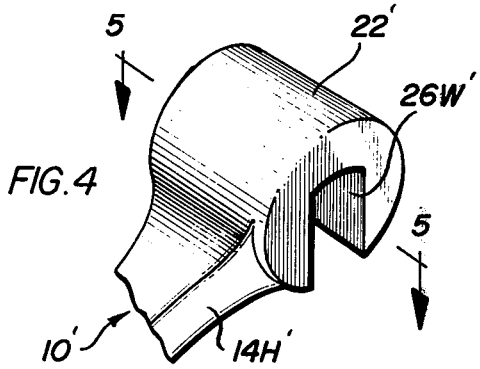
FIG. 4 is a perspective view of a modified portion of the tool of FIGS. 1–3.
Figure 5:
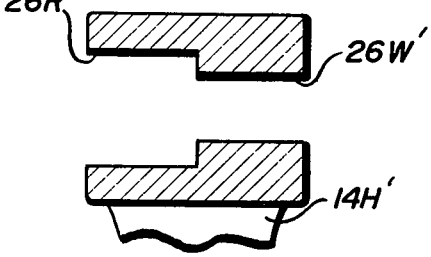
FIG. 5 is a sectional view of the portion shown in FIG. 4 as seen from the plane indicated by 5—5 in FIG. 4 when looking in the direction there indicated.

In at least its broader aspects, this feature of the invention is not limited to box wrenches but may also include open wrenches such as is shown in the alternative construction of FIGS. 4 and 5. In this alternative embodiment of a combination tool 10' the end 22' has a pair of open wrenches 26W' and 26R' connected to open to the side so as to present a smooth outer end surface to the hand 24 of a user.

Figure 6:
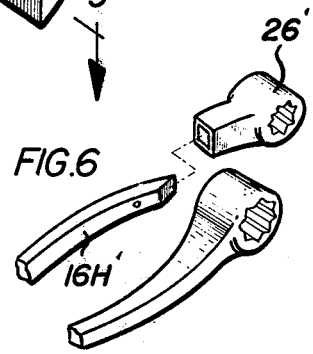
FIG. 6 is an elevational view of another embodiment of the invention.

FIG. 6 illustrates a further modification of this feature of the invention whenever the wrench pair 26' is formed so as to be detachable from the handle section 16H' so that an even greater variety of wrench sizes may be available to the user by selecting any one of a number of selectively detachable units such as the wrench unit 26'. In this arrangement the unit 26' is preferably detented on the handle 16H' in a conventional manner and the handle 16H' may include a scraping or chisel edge 16E.

Figure 7:
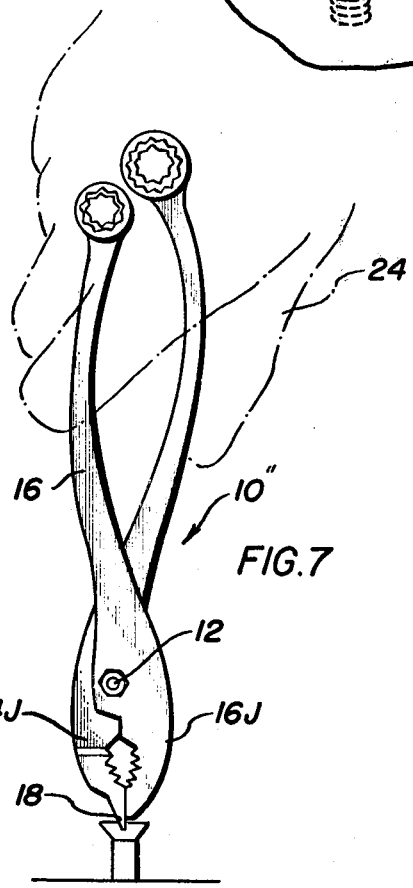
FIG. 7 is a perspective view similar to FIG. 4 of another modification to one portion of the tool.

FIG. 7 illustrates another embodiment of the invention and how it may be used. In this case the tool is designated 10'' and differs from the tool 10 by virtue of the fact that the screwdriving blade 18 is extended slightly from the end of the conforming jaw so as to allow it to be easily gripped and used by one hand 24. Of course, as in the illustration of FIG. 2, this tool 10'' may also have its member 16 used to supply greater torque.

When the tool 10 is used as a wrench by inserting the member 26 or 22 about a bolt it may be turned by applying pressure against the relatively smooth surface of the jaw handle area when the tool is in the arrangement shown, for example, FIG. 1. The torque may be increased in certain cases by opening the handles to their maximum position, where they lock naturally. If desired, a locking mechanism such as that shown in the aforementioned U.S. Pat. No. 1,321,777 may be employed so as to provide this leverage arm in all cases.

It should now be apparent that a convenient and easy to carry combination tool has been provided which tool allows each separate function to be done effectively and with little or no loss of efficiency. In the illustrated embodiment at least seven tools are combined: pliers, wire cutters, screwdriver, and four fixed sized wrenches. This combination tool can find convenient application in the home, the automobile or in the factory.

It should also be apparent that a unique combination tool of great versatility has been described. Although the several embodiments and alternative constructions have been detailed, it should here be emphasized that these are for illustrative purposes only and that the inventive features may find expression in a great variety of forms. It is thus the intention of the appended claims to encompass the inventive contribution to this art, limited only by the prior art, and it is desired that these claims be so construed.

What is claimed is:

1. A combination tool comprising:

a first and second plier member having a jaw section and a handle section, said plier members being pivotally attached together to allow the jaws to be pivotally displaced toward and away from each other by moving the handle sections to and away from each other; and the jaw section of one of said plier members having its end formed into a screwdriver blade with the extreme end of the handle portion of said one plier member having a wide smooth portion for aiding in gripping and applying pressure when the tool is used as a screwdriver.

2. The invention of claim 1 wherein said wide smooth portion of said handle is formed of at least one wrench means.

3. The invention of claim 2 wherein both handle end portions of said plier members have smooth surface wrench means.

4. The invention of claim 3 wherein said wrench means is a pair of different sized interopening wrench sections.

5. The invention of claim 1 wherein said screwdriver blade extends beyond the end of the other jaw so as to allow the tool to be used as a screwdriver when the jaws are closed.

6. The invention of claim 4 wherein said pair of interopening wrench sections are of the box end type and are formed together in a unitary manner.

7. The invention of claim 4 wherein said pair of interopening wrench sections are of the open end type, with their open ends opening to the side and not the rear and are formed together in a unitary manner.

8. In a combination tool of the type having a pair of pivotably interconnected handle members, each of which serves to move a forwardly positioned jaw member with both such handle members having rearwardly positioned wrench members coupled to them, and at least one of the pair of handle members and its associated jaw member and wrench member being substantially aligned with each other, the improvement comprising in combination therewith of:

a screwdriver blade point provided at the forward end of the jaw member associated with said one of said handle members, and a substantially smooth and broad rearward facing surface provided at that handle member's wrench member, whereby when the tool is used as a screwdriver and said screwdriver blade point is in use, the user's hand may conveniently and safely be pressed against the smooth rearward surface of said associated wrench member to apply pressure through the tool and to the blade point.

9. The improvement of claim 8, further characterized in that the other handle member from said one handle member is pivotable to a position substantially perpendicular to the said one handle member and handle members are interconnected so that when the screwdriver point of the jaw associated with said first handle member is in use, the second handle member may be used by the user to more easily apply torque to the screwdriver point.

* * * * *